United States Patent [19]

Nakazato et al.

[11] Patent Number: 4,534,678

[45] Date of Patent: Aug. 13, 1985

[54] OFFSHORE STRUCTURE AND METHOD OF CONSTRUCTING SAME

[75] Inventors: Takuzo Nakazato, Abiko; Koichiro Okuto, Tokyo; Toshio Kai, Kashiwa, all of Japan

[73] Assignee: Sumitomo Metal Industries, Ltd., Osaka, Japan

[21] Appl. No.: 465,482

[22] Filed: Feb. 10, 1983

[30] Foreign Application Priority Data

Feb. 24, 1982 [JP] Japan ..... 57-28604
Feb. 24, 1982 [JP] Japan ..... 57-28605

[51] Int. Cl.[3] ..... E02B 17/00

[52] U.S. Cl. ..... 405/204; 405/207; 405/210

[58] Field of Search ..... 405/203–210, 405/224

[56] References Cited

U.S. PATENT DOCUMENTS 2,528,089 10/1950 Siecke et al. ..... 405/205
2,900,794 8/1959 Sutton ..... 405/204
4,007,598 2/1977 Tax ..... 405/204 X
4,232,983 11/1980 Cook et al. ..... 405/210
4,371,292 2/1983 Takahashi et al. ..... 405/224

FOREIGN PATENT DOCUMENTS 2416306 10/1979 France ..... 405/204

*Primary Examiner*—David H. Corbin
*Attorney, Agent, or Firm*—Burns, Doane, Swecker & Mathis

[57] ABSTRACT

An offshore structure and method of constructing same are disclosed. The offshore structure comprises a jacket assembly, a bottom tank secured to the bottom of said jacket assembly and a movable tank which is vertically slidable along said jacket assembly and which can be positioned on said bottom tank as a ballasting and storage tank. The offshore structure further includes a guide mechanism between said jacket assembly and movable tank to guide the vertical sliding of said movable tank, a frictional plate disposed on the contact surface between said bottom tank and movable tank so as to permit the two tanks to slide relative to each other in a given horizontal movement, and a buffer disposed between said jacket assembly and movable tank.

9 Claims, 17 Drawing Figures

OFFSHORE STRUCTURE AND METHOD OF CONSTRUCTING SAME

BACKGROUND OF THE INVENTION

The present invention relates to an offshore structure, particularly one adapted to offshore oil production.

The typical conventional structure for developing offshore oil fields is a jacket (open steel-pipe/-framework) on which production equipment is installed and which is connected to the onshore station via an underwater pipeline. But because of the high cost of pipeline construction, such a conventional exploitation system becomes too expensive when used in small and medium (marginal) offshore oil fields. Developing small and medium oil fields may require: (1) the system is of "gravitational type" that substantially eliminates the need for driving piles into the sea bed; (2) the system is virtually free from fixing up equipment at site; and (3) the system obviates the need for laying down a long pipeline.

OBJECTS OF THE INVENTION

An object of the present invention is to provide an offshore structure or a system for exploiting small and medium offshore oil fields which has high cost performance and satisfies the above mentioned three requirements.

Another object is to provide an earthquake-proof offshore structure.

Still another object is to provide a method of constructing the above mentioned offshore structure or system for exploiting small and medium offshore oil fields.

SUMMARY OF THE INVENTION

In one aspect, the present invention resides in an offshore structure comprising a jacket assembly, a bottom tank secured to the bottom of said jacket assembly and a movable tank that is vertically slidable along said jacket assembly and which can be positioned on said bottom tank as a ballasting and storage tank, said structure further including a guide mechanism between said jacket assembly and movable tank to guide the vertical sliding of said movable tank, a frictional plate disposed on the contact surface between said bottom tank and movable tank so as to permit the two tanks to slide relative to each other in a given horizontal movement, and a buffer disposed between said jacket assembly and movable tank.

In another aspect, the present invention resides in a method of constructing an offshore structure comprising erecting an upper jacket on a vertically slidable movable tank which is temporarily retained on it, erecting a lower jacket preferably having the same shape as that of said upper jacket which is secured to a bottom tank, connecting said upper and lower jackets in the sea, towing the resulting jacket assembly to an offshore installation site as said jacket assembly is kept floating by said movable tank, reducing the buoyancy of said movable tank to slide said movable tank downward along said jacket assembly, and positioning said movable tank on said bottom tank as a weight or a ballasting and storage tank.

PREFERRED EMBODIMENTS OF THE INVENTION

Figure 1:
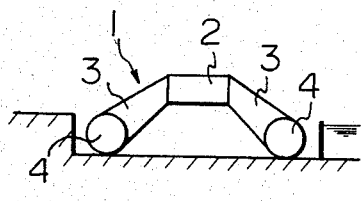
FIGS. 1 to 10 illustrate schematically the procedure of constructing the offshore structure of the present invention.
Figure 2:
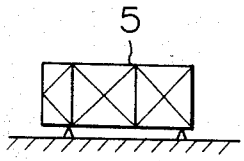
Figure 3:
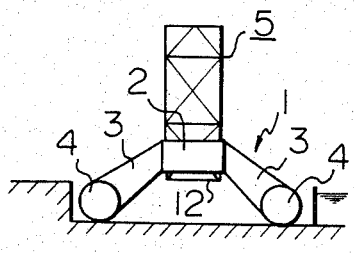
Figure 4:
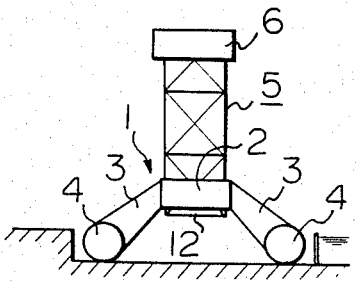
Figure 5:
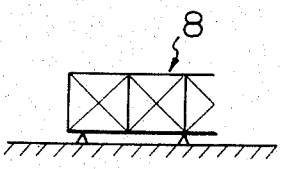
Figure 6:
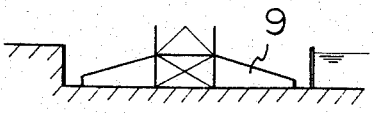
Figure 7:
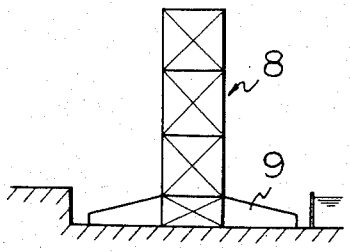
Figure 8:
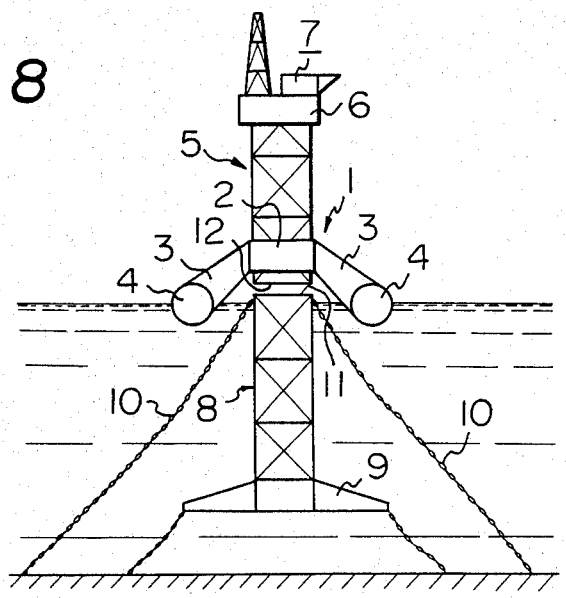

The present invention is now described by reference to one embodiment shown in the accompanying drawings in which the offshore structure of the present invention is constructed by the following procedure. First, a movable tank 1 is fabricated. The tank consists of a rectangular supporting frame 2 and a pair of hollow cylindrical tanks 4,4 secured to both sides of the frame through brackets 3,3. An upper jacket 5 is then fabricated and its lower end is inserted into the frame 2 to retain the movable tank 1 temporarily (FIG. 3). A deck 6 is placed on top of the upper jacket 5 and production equipment 7 is fixed on the deck 6 (FIG. 8). As shown in FIGS. 5 and 6, a lower jacket 8 is fabricated and connected to a bottom tank 9 at generally right angles (see FIG. 7).

Now, the upper jacket 5 on which the movable tank 1 is temporarily retained is connected under the sea or above the sea, as shown in FIG. 8, to the top end 11 of the lower jacket 8 that has been connected to the bottom tank 9 at generally right angles. More specifically, the lower jacket 8 connected to the bottom tank 9 is placed temporarily in the sea through mooring ropes 10,10. Then the upper jacket 5 on which the movable tank 1 is temporarily retained is lowered under the sea, and its lower end 12 is placed on the top end 11 of the lower jacket 8 that has been placed temporarily in the sea. The two jackets 5 and 8 are connected by welding or other means.

In FIG. 8, the top end 11 of the lower jacket 8 is kept above the sea. When the buoyancy of the movable tank 1 is high enough to keep the lower end 12 of the upper jacket 5 above the sea, the lower end 12 may be connected to the upper end 11 above the sea.

Figure 9:
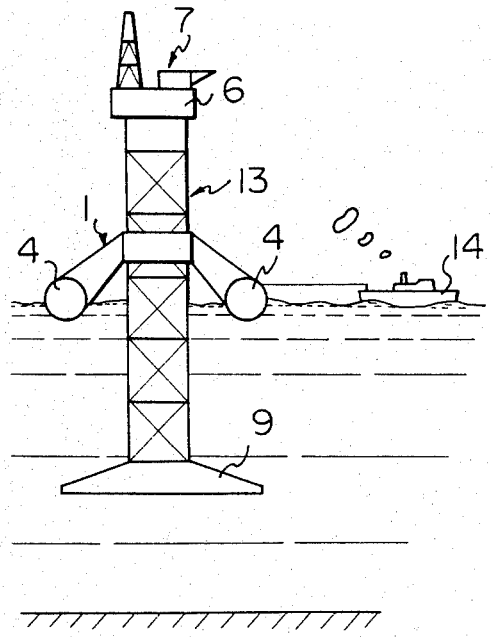

Subsequently, the mooring ropes 10,10 are removed from the lower jacket 8, whereupon a jacket assembly 13 made of the upper jacket 5 connected to lower jacket 8 floats in the sea by the buoyancy of the movable tank 1. The floating jacket assembly 13 is towed by a tug 14 to an offshore installation site (FIG. 9). The stability of the jacket assembly 13 during the towing is very high because by achieving optimum balance between the bottom tank 9 and movable tank 1, the center of gravity of the jacket assembly is lowered and the center of buoyancy is elevated in the sea, thus causing the assembly to be held vertically.

Figure 10:
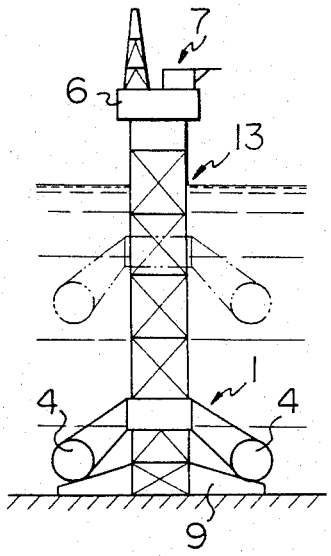
Figure 11:
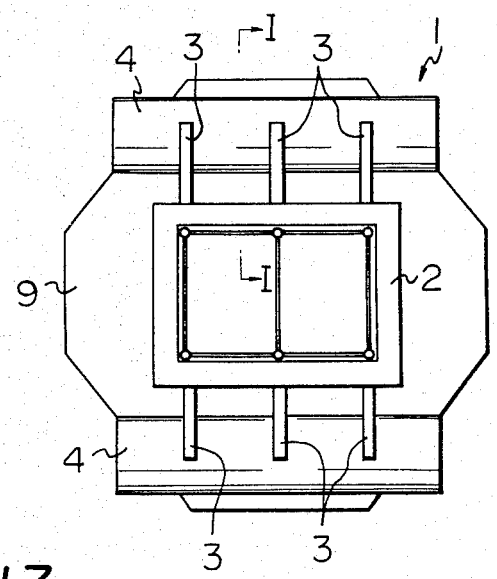
FIG. 11 is a plan view showing the movable tank positioned on the bottom tank.
Figure 12:
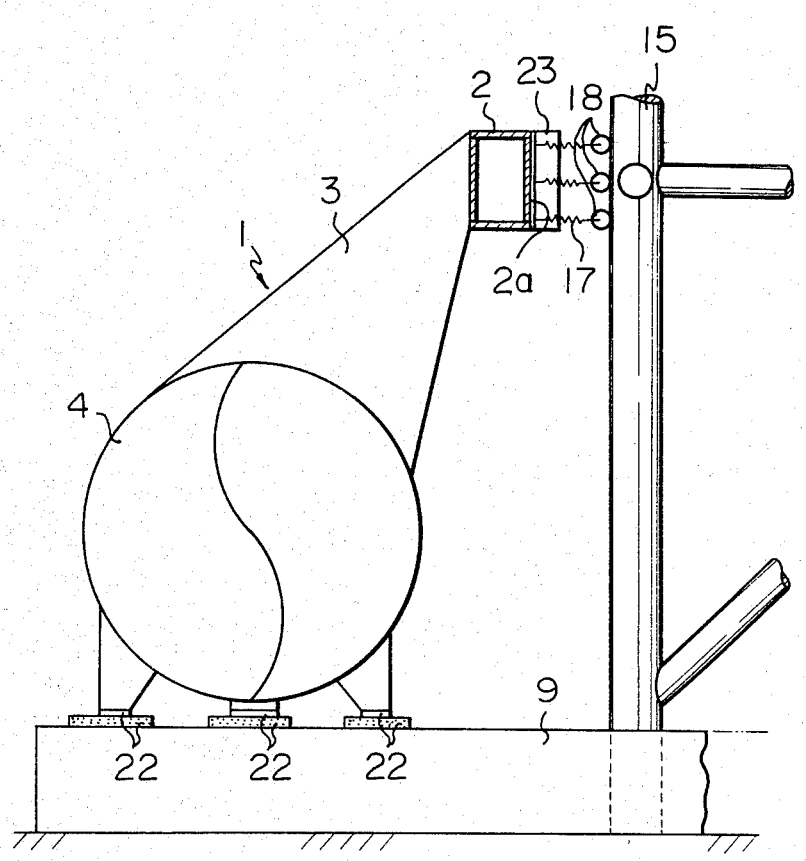
FIG. 12 is a sectional view taken along the I—I line of FIG. 11 and shows one embodiment of the guide mechanism, buffer and frictional plate.

When the assembly has been towed to the offshore installation site, the movable tank 1 is released from the temporarily retained position and seawater is injected into the cylindrical tanks 4,4 of the movable tank 1. Then, the buoyancy of the movable tank is gradually decreased to cause it to slide downward along the legs 15 of the jacket assembly 13 until it is positioned on the bottom tank 9 as a weigh (FIG. 10 and FIG. 12). As a result, the jacket assembly 13 is held in place in the sea due to the weight of the movable tank 1. FIG. 11 is a plan view of the movable tank 1 positioned on the bottom tank 9.

The tanks 4,4 of the movable tank 1 contains seawater, but they may be used as oil storage tanks by effecting "oil-water replacement". The bottom tank 9 can also be used as an oil storage tank but it may be replaced by a solid ballast.

Another advantage of the offshore structure for oil production of the present invention is that it can be put to another oil field by the following procedure. First, the movable tank 1 is emptied of crude oil and instead is filled with seawater. By subsequently removing the seawater, the movable tank 1 slides upward through buoyancy until it comes into another engagement with the position where it is temporarily retained on the upper jacket 5. By completely removing the seawater from the cylindrical tanks 4,4, the jacket assembly 13 comes to float in the sea through the buoyancy of the movable tank 1. Then, as shown in FIG. 9, the floating jacket assembly 13 can be towed by a tug 14 to the next installation site where it is erected on the sea bed by repeating the procedure described hereinbefore.

Figure 13:
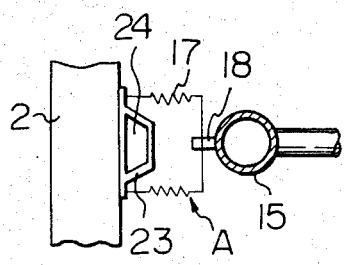
FIG. 13 is a partially enlarged cross section showing the guide mechanism and shock absorber in their completed position.

When the movable tank 1 is caused to slide downward along the legs 15 of the jacket assembly 13, it may experience lateral displacement of rolling. To prevent this, a guide mechanism A is formed within the supporting frame 2 of the movable tank 1. One embodiment of this guide mechanism A is now described by reference to FIGS. 12 and 13. FIG. 12 is a sectional view taken along the I—I line of FIG. 11. FIG. 13 is a partial enlarged cross sectional view of the guide mechanism and buffer (shock absorber). Spring elements are connected in a rectangular form and extend from the inner wall *2a* of the supporting frame 2 to form an second frame 17. The second frame 17 provided surrounding the jacket assembly 13 contacts the legs 15 of the jacket assembly 13 through a plurality of rollers 18. While this is the construction of guide mechanism A used in the illustrated embodiment, it should be understood that other constructions may also be used if they permit the movable tank 1 to slide downward without lateral or horizontal displacement or rolling.

The jacket assembly 13 with the submerged movable tank 1 positioned on the bottom tank 9 as a weight may be hit by an earthquake. To render the jacket assembly 13 earthquake-proof, as shown in FIGS. 12 and 13, a shock absorber i.e. buffer 23 of any one of various types is preferably disposed between the supporting frame 2 of the movable tank 1 and the legs 15 of the jacket assembly 13. Thus, in a preferred embodiment of the present invention, the offshore structure of the present invention has earthquake-proof features and hence is protected against seismic shocks.

Figure 14:
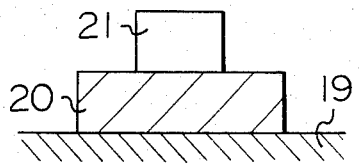
FIG. 14 is a schematic diagram showing the theory behind the earthquake-proof feature of the present invention.

The theory behind the earthquake-proof features incorporated in the present invention is described by reference to FIG. 14:

When the sea bed 19 is subjected to horizontal vibration together with an overlying foundation, an object 21 on the foundation 20 remains stationary if the interface between the object and foundation is smooth.

In addition, when an offshore structure of gravitational type as contemplated by the present invention is subjected to horizontal force, bottom tank 9 will not slide on the sea bed 19 if the following relation (1) is satisfied:

$$FH \leqq \mu\omega \ldots \quad (1)$$

wherein

FH: the horizontal force acting on the entire structure;

$\mu$: the coefficient of friction in horizontal direction between bottom tank 9 and sea bed 19; and $\omega$: the weight of the structure in water.

Obviously, if $\mu\omega$ is constant, the stability to sliding is increased as FH is decreased.

The method of reducing FH is hereunder considered. When the movable tank 1 is positioned on the bottom tank 9 through a predetermined sliding face, the following explanation will apply. When an offshore structure of gravitational type moves in the sea in a horizontal direction at an acceleration $\alpha$, FH is represented by the following equation (2):

$$FH = CM\frac{\omega_o}{g}Va\alpha + FT \quad (2)$$

wherein:

CM: reaction to an object of a unit volume moving in the sea caused by the resulting turbulent seawater (CM is also referred to as additional mass coefficient);

$\omega_o$: the density of the seawater;

g: acceleration of gravity;

Va: the volume of displacement by bottom tank 9 and jacket assembly 13; and FT: the horizontal force acting on the movable tank 1.

When the acceleration $\alpha$ and the reaction of the seawater to the movable tank 1 are not large enough to cause sliding between the movable tank 1 and bottom tank 9, FT is expressed by the following equation (3):

$$FT = CM\frac{\omega_o}{g}Vt\alpha \quad (3)$$

wherein

Vt: the volume of displacement by the movable tank.

If the acceleration $\alpha$ and the reaction of the seawater to the movable tank 1 are large enough to cause sliding between the movable tank 1 and bottom tank 9, FT is expressed by the following equation (4):

$$FT = \mu'\alpha t \ldots \quad (4)$$

wherein:

$\mu'$: the coefficient of dynamic friction between the movable tank 1 and bottom tank 9; and $\omega t$: the weight of the movable tank 1 in water.

The critical value of FT at which sliding occurs is:

$$CM\frac{\omega_o}{g}Wt\alpha = \mu wt \quad (5)$$

wherein:

$\mu$: the coefficient of static friction between movable tank 1 and bottom tank 9.

Usually, $\mu'$ is about a tenth of $\mu$. Therefore, FT is expressed by (4) after sliding has taken place between the movable and bottom tanks is much smaller than FT before the sliding as expressed by (3), and by sliding the movable tank 1, the horizontal force FH in equation (2) that acts on the entire structure in an earthquake can be reduced, and this results in the increased stability against sliding represented by the relation (1).

Based on these formulas, the offshore structure of the present invention has a frictional plate 22 of a static frictional coefficient of about 0.05 to 0.3 on the contact surface of either the movable tank 1 or bottom tank 9 or both, so that the movable tank 1 slides relative to the bottom tank 9 under the horizontal force of an earthquake having a magnitude of about 8, whereas the two tanks move as one body if waves, current and other natural forces keep applying a horizontal force whose magnitude is about half that of the earthquake. The stated frictional coefficient assumes a water depth of 100 m, a wavelength of 20 m, a period of 13 seconds and a tidal speed of 3 knots. The frictional coefficient of the plate 22 may vary depending upon the environmental conditions.

When the movable tank 1 slides relative to the bottom tank 9, the movable tank may strike the legs 15 of the jacket assembly 13. Therefore, some clearance is provided between the supporting frame 2 of the movable tank 1 and the legs 15 of the jacket assembly 13, and at the same time, a shock absorber i.e. buffer 23 to reduce the shock from the impingement on the legs 15 is provided around the inner periphery of the supporting frame 2.

One embodiment of the buffer or shock absorber 23 is shown in FIGS. 12 and 13. In this embodiment, the absorber is made of a hollow trapezoidal element 24 which is secured to the inner wall 2*a* of the frame 2 parallel to each leg 15. It should be unerstood that the absorber may assume other forms.

Figure 15A:
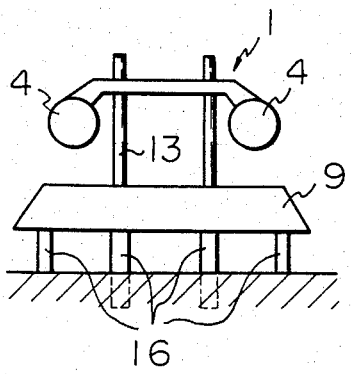
FIGS. 15 (a) and (b) show schematically how projections formed on the underside of the bottom tank are driven into the sea bed.
Figure 15B:
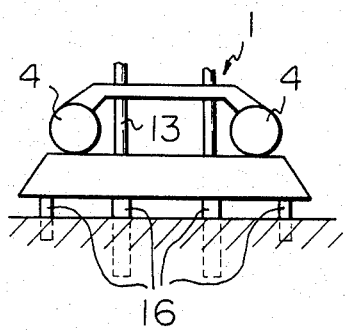

In addition, it sometimes occurs that the weight of the movable tank 1 alone is not sufficient to prevent lateral displacement of the jacket assembly 13 in the sea. If this is expected, as shown in FIGS. 15(*a*) and 15(*b*), a plurality of projections 16 of various lengths may be formed on the underside of the bottom tank 9 and driven into the sea bed under the weight of the jacket assembly 13 and movable tank 1. It should be understood that the projections 16 are only one example of the means for preventing the lateral displacement of the jacket assembly 13 and various methods may be used to achieve the same object.

Having the construction described above, the the offshore structure of the present invention can withstand an earthquake of a magnitude of about 8 and under moderate sea conditions, the structure is free from lateral movement.

Figure 16:
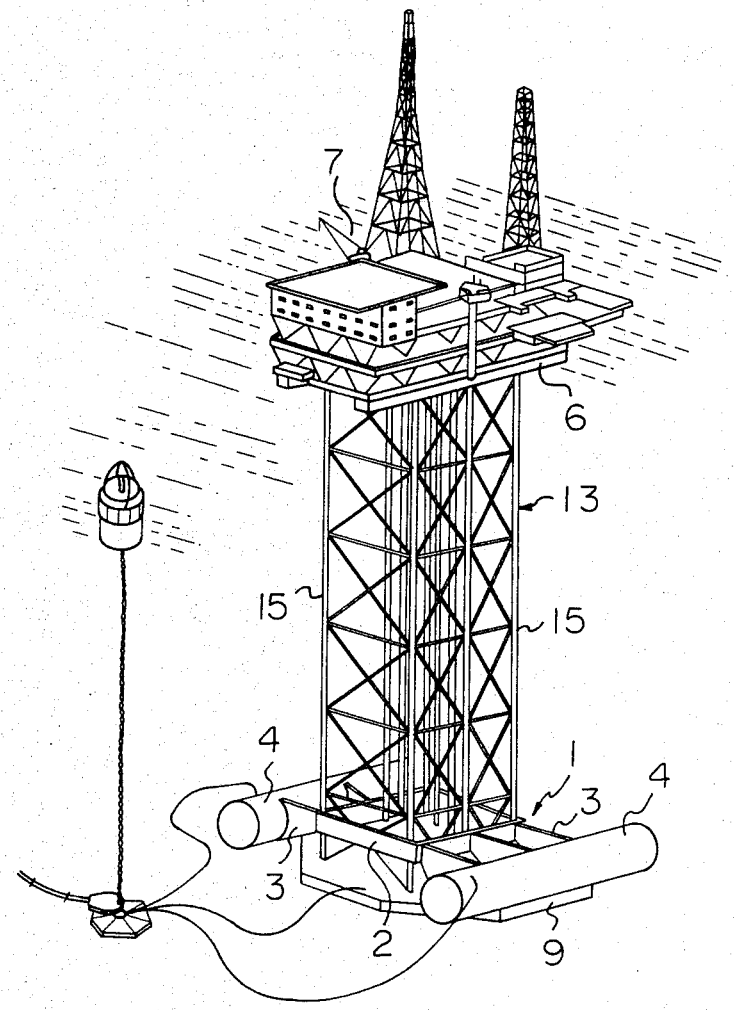
FIG. 16 is a perspective view of the offshore structure of the present invention in service.

FIG. 16 is a perspective view of the offshore structure of the present inventon in service. It is to be noted that FIG. 16 shows the case in which the movable tank 1 having cylindrical tanks 4,4, a rectangular supporting frame 2 and brackets 3,3 horizontally positioned is placed on the bottom tanks having a flat upper surface such as shown in FIG. 12. In the illustrated embodiment, two cylindrical tanks 4,4 are secured to the supporting frame 2 of the movable tank 1, but four tanks 4,4,4,4 may be fastened to the four sides of the supporting frame 2 of the movable tank 1.

Having the features described above, the offshore structure of the present invention has the following advantages over the prior art technique:

(1) The individual components of the offshore structure can be fabricated at a small or medium dock yard;

(2) The offshore structure can be constructed with minimum work on an offshore installation site;

(3) The offshore structure can be constructed without special construction machines;

(4) The offshore structure has the oil storage capacity, so it eliminates the need for a long pipeline extending to an onshore station;

(5) The offshore structure can be put to another oil field; and (6) The method of the present invention can construct an offshore structure of consistent performance within a short time period.

Although the present invention has been described with preferred embodiments it is to be understood that variations and modifications may be employed without departing from the concept of the present invention as defined in the following claims.

We claim:

1. An offshore structure comprising a jacket assembly, a bottom tank secured to the bottom of said jacket assembly for providing ballast to said jacket, a movable tank and means for connecting said movable tank to said jacket so that said movable tank is vertically slidable along said jacket assembly, said movable tank being positionable on said bottom tank for providing ballast and storage, said movable tank being positionable spaced from said bottom tank for providing flotation to said structure, said means for connecting including a supporting frame movably coupled with said jacket assembly, a plurality of brackets connecting said movable tank to said supporting frame, and a guide mechanism between said jacket assembly and said supporting frame to guide the vertical sliding of said movable tank, and a buffer disposed between said jacket assembly and movable tank.

2. The offshore structure defined in claim 1 in which said guide mechanism comprises a plurality of rollers contacting the jacket assembly and a second frame which extends from said supporting frame and includes elastic members for supporting said plurality of rollers.

3. The offshore structure defined in claim 1, in which said buffer is comprised of a hollow trapezoidal element secured to said supporting frame.

4. The offshore structure defined in claim 1, in which a frictional plate is disposed on a contact surface between said bottom tank and movable tank so as to permit the two tanks to slide relative to each other in a given horizontal movement in response to the horizontal force of an earthquake having a magnitude in excess of a predetermined value, and said frictional plate is disposed on all the contact surface between said bottom tank and movable tank.

5. The offshore structure defined in claim 1, in which at least one projection is provided on the underside of said bottom tank, said projection being driven into the sea bed to prevent a horizontal displacement of said jacket assembly.

6. A method of constructing an offshore structure comprising the steps of: erecting an upper jacket on a vertically slidable movable tank which is temporarily retained on it, assembling a lower jacket which is secured to a bottom tank, connecting said upper and lower jackets in the sea, towing the resulting jacket assembly to an offshore installation site as said jacket assembly is kept floating by said movable tank, reducing the buoyancy of said movable tank to slide said movable tank downward along said jacket assembly, and positioning said movable tank on said bottom tank as a ballasting and storage tank.

7. The method defined in claim 6, in which the buoyancy of said movable tank is reduced by injecting the seawater into each tank which constitutes said movable tank.

8. The method defined in claim 6, in which said upper jacket is connected to said lower jacket in an area above the surface of the sea by positioning the lower end of said upper jacket as high above the sea as to place it on the top end of said lower jacket, said top end being also retained above the sea.

9. The method defined in claim 6, wherein said connecting step includes spacing said movable tank from said bottom tank.

* * * * *